United States Patent [19]

Zimmermann

[11] Patent Number: 4,669,631

[45] Date of Patent: Jun. 2, 1987

[54] CONTAINER OR JUG WITH A DETACHABLE SWIVEL LID

[75] Inventor: Anso Zimmermann, Niederaula, Fed. Rep. of Germany

[73] Assignee: Rotpunkt Dr. Anso Zimmermann, Niederaula, Fed. Rep. of Germany

[21] Appl. No.: 873,960

[22] Filed: Jun. 13, 1986

[30] Foreign Application Priority Data

Jul. 16, 1985 [DE] Fed. Rep. of Germany ..... 3525378

[51] Int. Cl.[4] ..... B65D 43/14; B65D 51/04

[52] U.S. Cl. ..... 220/341; 220/338

[58] Field of Search ..... 220/337, 338, 341, 420, 220/421, 422, 426

[56] References Cited

U.S. PATENT DOCUMENTS 2,342,477 2/1944 Magnenat ..... 220/338

4,301,942 11/1981 Kupperman et al. ..... 220/338

FOREIGN PATENT DOCUMENTS 816300 10/1951 Fed. Rep. of Germany ..... 220/341

*Primary Examiner*—George T. Hall

*Attorney, Agent, or Firm*—Scully, Scott, Murphy & Presser

[57] ABSTRACT

The invention relates to a container or a jug, more particularly an insulating jug, consisting of a housing (2) with an opening (27) on the upper side and a swivel lid (3) which may be swivelled between its closed position and an open position in which it at least partially unblocks the opening (27) in a swivel bearing (5) with swivel axis located beyond the opening (27), the swivel bearing (5) being formed by holding members (7, 8) on the swivel lid and housing sides, the holding member (7) on the swivel lid side being formed by a hook-shaped extension (9) which overlaps the holding member (8) on the housing side and engages behind it on the side remote from the opening (27). The object of the invention is to design the container in such a way that the swivel lid (3) is locked in its sealing position to prevent its detachment. This object is achieved by arranging on the holding member (7) on the swivel lid side a stopping cam (16) which projects downwards and which in the sealing position of the swivel lid (3) engages behind a shoulder (17) on the swivel bearing (5) on the side facing the opening (22).

9 Claims, 4 Drawing Figures

CONTAINER OR JUG WITH A DETACHABLE SWIVEL LID

TECHNICAL FIELD OF THE INVENTION

The invention relates to a container or a jug, more particularly an insulating jug, consisting of a housing with an opening on the upper side and a swivel lid which may be swivelled between its closed position and its open position, in which it at least partially unblocks the opening in a swivel bearing with its swivel axis located beyond the opening.

BACKGROUND OF THE INVENTION AND PRIOR ART

In this swivel lid construction, the detachable swivel lid is secured against slipping out of the swivel bearing when the container is greatly inclined in its pouring-out position by a holding member on the swivel lid side engaging behind a holding member on the housing side on the side of the housing remote from the opening. As the swivel lid is to be easily detachable, the engagement described is only slight. Even this is sufficient to secure it against slipping out when the container is greatly inclined in its pouring-out position, because the container is only tilted slightly more than 90° to pour out the residual liquid. To guarantee the previously mentioned easy detachment of the swivel lid, the swivel bearing is formed in the known design in the sense of a pocket into which the holding member on the swivel lid side is inserted. The insertion movement is then obliquely downwards towards the container. The withdrawal movement is in the opposite direction.

While a design of this kind does guarantee very simple and convenient removal and re-insertion of the swivel lid, it has been found in practice that it is favourable if the swivel lid is locked in its sealing position so that it does not accidentally slip out of position, which cannot be ruled out during normal handling of the container, for example, as a result of awkward movements.

OBJECT OF THE INVENTION

The object underlying the invention is to design a container of the kind specified in the introduction in such a way that the swivel lid is locked in its sealing position to prevent its detachment.

SUMMARY OF THE INVENTION

This object is achieved through the features contained in the characterising part of claim 1.

In the design according to the invention a stopping cam and a shoulder cooperating therewith are associated with the holding members in the swivel bearing to prevent the swivel lid from being removed when in its sealing position. In the design according to the invention, a stopping cam projects downwards from the swivel lid side holding member and in the sealing position of the swivel lid engages behind a shoulder on the swivel bearing on the side of the shoulder facing the opening. The stopping cam extends both downwards and at the same time transversely to the direction of movement in which the swivel lid can be removed from the swivel bearing. In the sealing position of the swivel lid, the latter is thus upwardly secured by the engagement of the holding member on the swivel lid side behind the swivel bearing side holding member, and is secured against movement in the direction of withdrawal through the engagement of the stopping cam behind the shoulder. This engagement is released, in the design according to the invention, by slight opening, that is to say by slight swivelling in the opening direction, so that the swivel lid can, in this position, be removed from or inserted into the swivel bearing. As a result of the swivelling into the closed position, the swivel lid is secured or locked automatically, because the stopping cam is swivelled in front of the shoulder where it abuts against the shoulder and thus prevents the withdrawal of the swivel lid.

The development according to the invention is thus distinguished by simplicity, because the stopping cam can be preformed on the present holding member on the swivel lid side and because a shoulder can likewise be simply produced on the housing side holding member, for example, by means of a pocket-shaped recess of which the limiting wall more remote from the housing forms the shoulder, as described in claim 2.

It is advantageous to arrange or preform the stopping cam on the extension which forms the holding member on the swivel lid side and which extends in approximately the same direction.

In the design according to claim 5 the stopping cam and the shoulder are integrated into a well-tried construction in which two holding members are provided on the swivel lid side which overlap in a U-shaped manner a handle of the container in which the holding members on the housing side are moulded. Consequently in the design according to claim 5 a stopping cam and a shoulder are present on each side of the handle.

Claims 6 to 9 include forms which are distinguished by simplicity and usefulness in a functional sense. Moreover, as a result of the design according to claim 9, the stopping cams are at least partially covered, and this design thus serves to improve the pleasing exterior of the container.

BRIEF DESCRIPTION OF THE DRAWINGS

An exemplary embodiment of the invention will now be described with the aid of a simplified drawing, in which.

DETAILED DESCRIPTION OF A PREFERRED EMBODIMENT OF THE INVENTION

Figure 1:
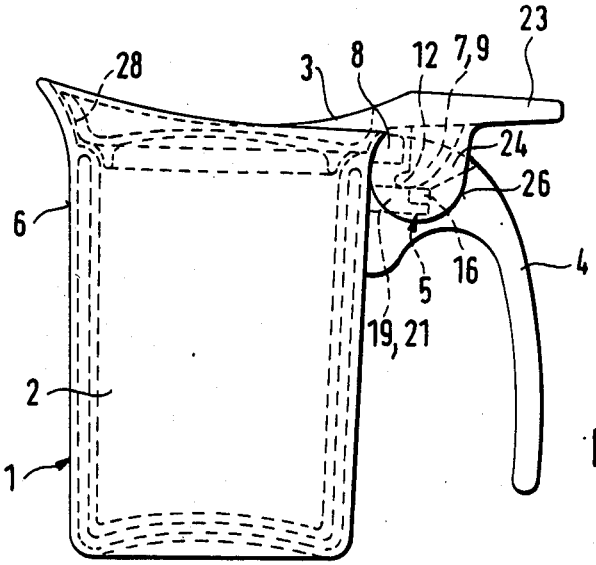
FIG. 1 shows a side view of a container according to the invention.
Figure 2:
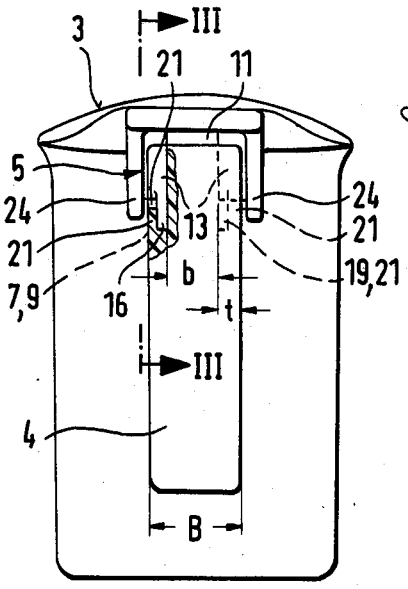
FIG. 2 shows a side view from the right of the container according to FIG. 1.

The container is an insulating jug denoted generally in FIG. 1 by 1 and consisting of a housing 2, a swivel lid 3 and a handle 4.

The housing 2 consists of double-walled sheet metal, with the sheet walls being spaced from each other and a heat-insulating medium located in the cavity between them. The swivel lid 3 and the handle 4 are made of plastic. A swivel bearing 5 for the swivel lid 3 is arranged in the upper region of the handle 4, said bearing being formed by a so-called plug bearing. By virtue of this design it is possible to plug the swivel lid 3 into the swivel bearing 5 obliquely downwards in the direction of the pouring-out point 6 of the insulating jug 1 and to remove it from the swivel bearing 5 in the opposide direction. This design makes it possible to have a small swivel range for partial opening of the swivel lid 3, because swivelling the swivel lid upwards merely serves the purpose of pouring out which only requires a small flow of liquid. For filling the insulating jug 1 the swivel lid 3 is removed in the manner previously described.

The swivel bearing 5 is formed by a holding member 7 on the swivel lid side and a holding member 8 on the housing side which mutually engage in a form-locking manner. The holding member 7 on the lid side is formed by a hook-shaped extension 9 which first runs radially outwards and then bends back downwards to form a hook. A recess 11 which extends radially in the extension 9 forms hook tips 12 which are spaced from each other and which enter cutouts 13 that are arranged in the handle 4 on both sides and which are open upwards. The hook tips 12 overlap and engage behind the holding members 8 on both sides, or their walls 14 remote from the housing and undersides 15 which, at the same time, form walls of the cutout 13 close to the housing. The extensions 9 or the hook tips 12 have a swivel clearance in the cutouts 13 which renders partial opening of the housing 2 possible.

Extending downwards from the lower end of each extension 9 is a stopping cam 16 which in the closed position of the swivel lid 3 adjoins a shoulder 17 formed by the wall 18 of the cutout 13 remote from the housing. The stopping cams 16 are received in pocket-shaped recesses 19 which are covered laterally by side walls 21 of the handle 4. The pocket-shaped recesses 19 are extensions of the cutout 13 and terminate on the side facing the housing 2 of the handle 4, which is removably fastened by means of a screw (not shown).

In the sealing position (FIG. 1) the stopping cams 16 are located directly in front of the shoulder 17 and the hook tips 12 engage behind and below the housing side holding member 8. As the length 1 of the stopping cams is greater than the clearance s between the holding members 8 and the hook tips 12, withdrawal of the swivel lid 3 is prevented.

Figure 3:
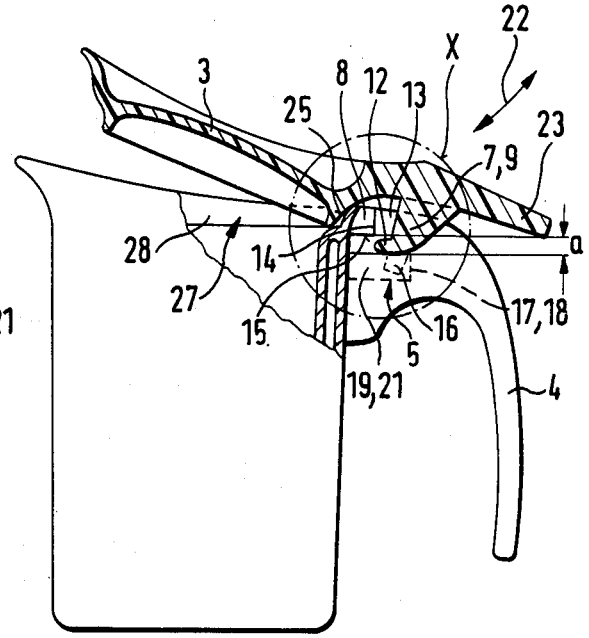
FIG. 3 shows the container according to FIG. 1 with lid lifted up and with a partial section on on the line III—III in FIG. 2.
Figure 4:
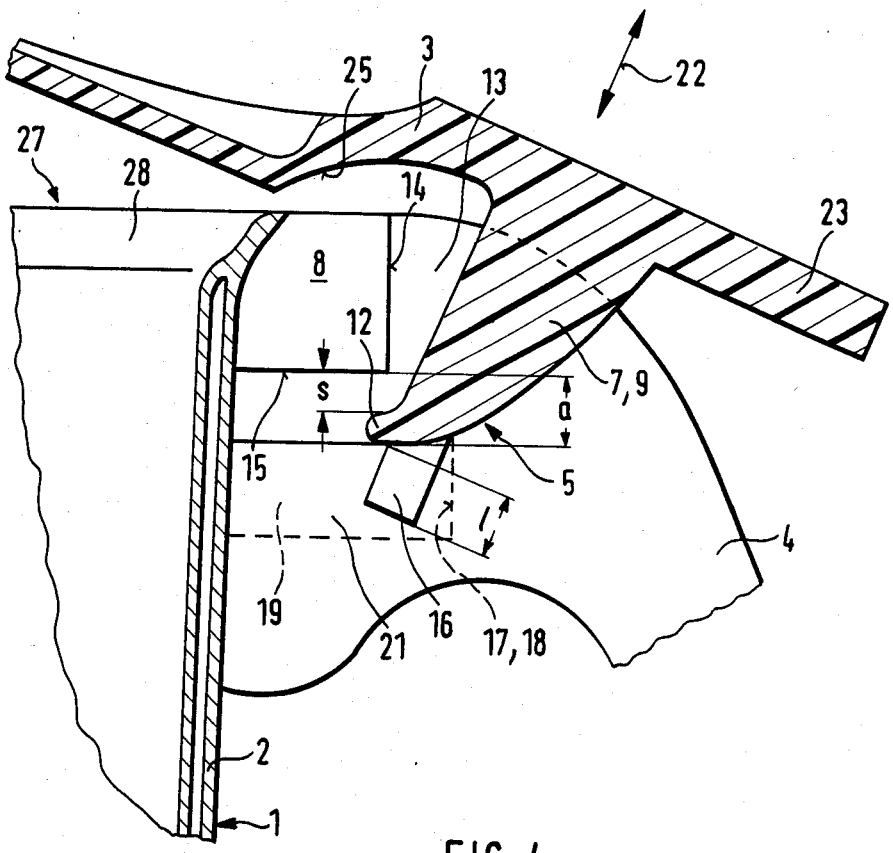
FIG. 4 shows an enlarged representation of the detail marked with X in FIG. 3.

In the open position of the swivel lid 3, shown in FIGS. 3 and 4, the stopping cams 16 are swivelled away from the shoulder 17. The locking system thus becomes ineffective if the hook tips 12 are withdrawn in the direction of the double arrow 22. A distance a between the underside 15 of the housing side holding member 8 and the upper end of the shoulder 17 then proves to be favourable. The swivel lid can be withdrawn from the swivel bearing 5 and inserted again along the double arrow 22. The swivel lid 3 is swivelled open by pressure on a pressure member 23 which extends radially outwards above the handle 4 and which can, for example, be pressed down with the thumb of the operating hand holding the insulating jug 1 by the handle. Closure of the swivel lid 3 takes place automatically through the weight of the swivel lid 3.

The width B measured across the hook tips 12 corresponds to the width of the handle 4. The outer limit of the hook tip 12 is therefore in alignment with the sides of the handle 4. In order to give the hook tips 12 greater firmness, they are provided on both outer sides with walls 24 as stiffening ribs, which extend from the edge 25 of the swivel lid 3 and are connected with the outer sides of the hook tip 12. Within the scope of the invention there are many possible ways of connecting the walls 24 with both the edge 25 of the swivel lid 3 and the hook tips 12, for example by adhesion. In a preferred design the walls 24 are preformed integrally on the swivel lid 3 and, in each case, on a hook tip 12 or the holding member 7 on the swivel lid side.

The walls 24 not only impart a high degree of stability to the hook tips 12 or the holding member 7 on the swivel lid side, but they are also guide surfaces, enclosing the handle 4 between their inner sides with movement clearance. Moreover, the walls 24 form a screen which conceals the holding members 7, 8 and also the cutout 13 in the handle 4. As the walls 24 participate in the swivelling movement of the swivel lid 3, it is recommended that their edges 26 be rounded. It is also possible to bring the distance B between the holding members 7 into line with the depths t of the cutouts 13 so that the lateral guide is formed in this way.

Not only do the walls 24 and the hook tips 12 form an integral structure, but the pressure member 23 also forms an integral extension thereof. The swivel lid side holding member 7, the walls 24 and the pressure member 23 thus form a stable preformed part on the swivel lid 3, which part, by virtue of the special design, can be produced simply from plastic, more particularly by injection moulding.

It is possible to arrange the pressure member 23 in such a way that it rests upon the handle 4 in the desired (partial) opening position of the housing 2.

The upper rim 28 of the opening 27 of the housing 2 is bent obliquely upwards and outwards.

The rim 25 of the swivel lid 3 is adapted to the rim 28 of the housing 2 and runs obliquely upwards. In the closed position, the rims 25, 28 abut each other. In this way, an inclined plane is created on the side of the opening 27 facing the handle 4, which plane operates in the direction of withdrawal or insertion (double arrow 22) and can be incorporated in the locking or stopping of the swivel lid 3.

Within the scope of the invention it is possible to use swivel lid side and housing side holding members 7, 8 of other shapes, although the holding members 7, 8 described above represent a preferred design.

Shapes and fastenings for the handle other than the handle shape shown are also possible, in which the handle first extends radially outwards and is then bent downwards. The shape of the handle 4 shown is preferred. The way it is attached on one side is not shown in more detail; this can be effected, for example, by means of adhesion or screws.

What is claimed is:

1. A container or jug, more particularly an insulating jug, consisting of a housing with an opening on the upper side and a swivel lid which may be swivelled between its closed position and its open position in which it at least partially unblocks the opening in a swivel bearing with its swivel axis located beyond the opening, characterised in that the swivel bearing is formed by holding members on the swivel lid side and the housing side, the holding member on the swivel lid side being formed by a hook-shaped extension which overlaps the holding member on the housing side and which engages behind it on the side remote from the opening, and that on the holding member on the swivel lid side there is arranged a stopping cam which projects downwards and which in the sealing position of the swivel lid engages behind a shoulder on the swivel bearing on the side facing the opening.

2. A container or jug according to claim 1, characterised in that the shoulder is formed by a wall which limits a pocket-shaped recess for receiving the stopping cam.

3. A container or jug according to claim 1 or claim 2, characterised in that the stopping cam is arranged on the extension.

4. A container or jug according to claim 1, characterised in that the holding members on the swivel lid side and the housing side are covered on both sides by walls which are connected with the swivel lid or the handle and each carry a holding member on their mutually facing inner sides, which members laterally overlap the handle in a forked manner.

5. A container or jug according to claim 1, characterised in that arranged on the holding member on the swivel lid side there are two extensions which laterally overlap the handle in a forked manner, and that a stopping cam is arranged on each extension.

6. A container according to claim 5, characterised in that the pocket-shaped recesses for the stopping cams extend continuously upwards and also serve to receive the extensions.

7. A container according to claim 6, characterised in that the holding member on the housing side is formed by walls of the pocket-shaped recesses adjacent to the housing.

8. A container according to one of claims 4 to 7, characterised in that the handle is detachably fastened to the housing and the pocket-shaped recesses terminate on the side of the handle facing the housing.

9. A container according to one of claims 4 to 7, characterised in that the pocket-shaped recesses are covered laterally at least partially by side walls of the handle.

* * * * *